United States Patent [19]

Landecker

[11] Patent Number: 4,757,922

[45] Date of Patent: Jul. 19, 1988

[54] LIQUID DISPENSER

[75] Inventor: David J. Landecker, Santa Barbara, Calif.

[73] Assignee: Menda Scientific Products, Inc., Santa Barbara, Calif.

[21] Appl. No.: 933,467

[22] Filed: Nov. 20, 1986

[51] Int. Cl.[4] ..... B67D 5/06

[52] U.S. Cl. ..... 222/205; 222/321

[58] Field of Search ..... 222/205, 207, 321, 129, 222/135, 320, 382, 383, 385, 405

[56] References Cited

U.S. PATENT DOCUMENTS

| | | | |
|---|---|---|---|
| 2,378,624 | 6/1945 | Edwards | 222/321 X |
| 2,593,591 | 4/1952 | Menkin et al. | 222/205 |
| 2,774,517 | 12/1956 | Teegardin et al. | 222/205 |
| 2,830,396 | 4/1958 | Gowland | 222/205 X |
| 3,131,833 | 5/1964 | Campbell, Jr. et al. | 222/205 X |
| 3,246,807 | 4/1966 | Micallef | 222/207 |
| 3,874,561 | 4/1975 | Zackheim et al. | 222/207 |
| 4,432,470 | 2/1984 | Sopha | 222/135 |
| 4,678,103 | 7/1987 | Dirksing | 222/129 X |

FOREIGN PATENT DOCUMENTS

| | | | |
|---|---|---|---|
| 844420 | 6/1970 | Canada | 222/205 |

*Primary Examiner*—Joseph J. Rolla
*Assistant Examiner*—Nils E. Pedersen
*Attorney, Agent, or Firm*—Herzig & Yanny

[57] ABSTRACT

A dispenser for liquid acrylic resin and powder, the dispenser having a dish, a raised inlet above the dish, and a shield for the inlet. A bottle or the like is mounted in coaxial relation therewith for dispensing fresh quantities of liquid from the reservoir bottle to the dispenser dish. The outlet in the dispenser dish is above the level of the liquid contained in the dish to prevent return of the liquid and has an umbrella-like shield over the inlet to prevent the backflow to prevent contaminated resin from returning to the bottle.

7 Claims, 1 Drawing Sheet

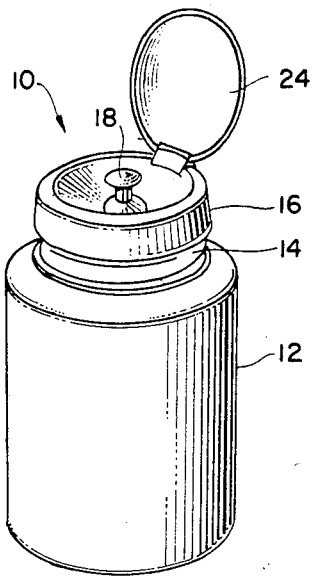
FIG. 1.
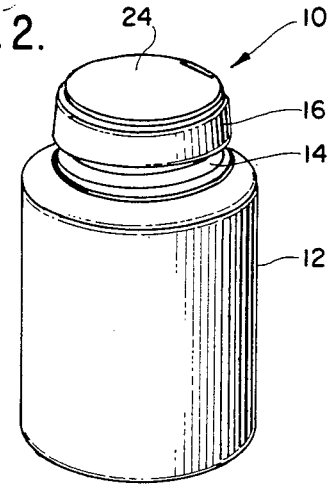
FIG. 2.
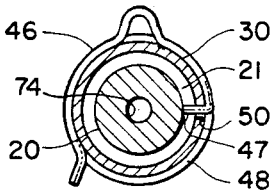
FIG. 5.
FIG. 3.
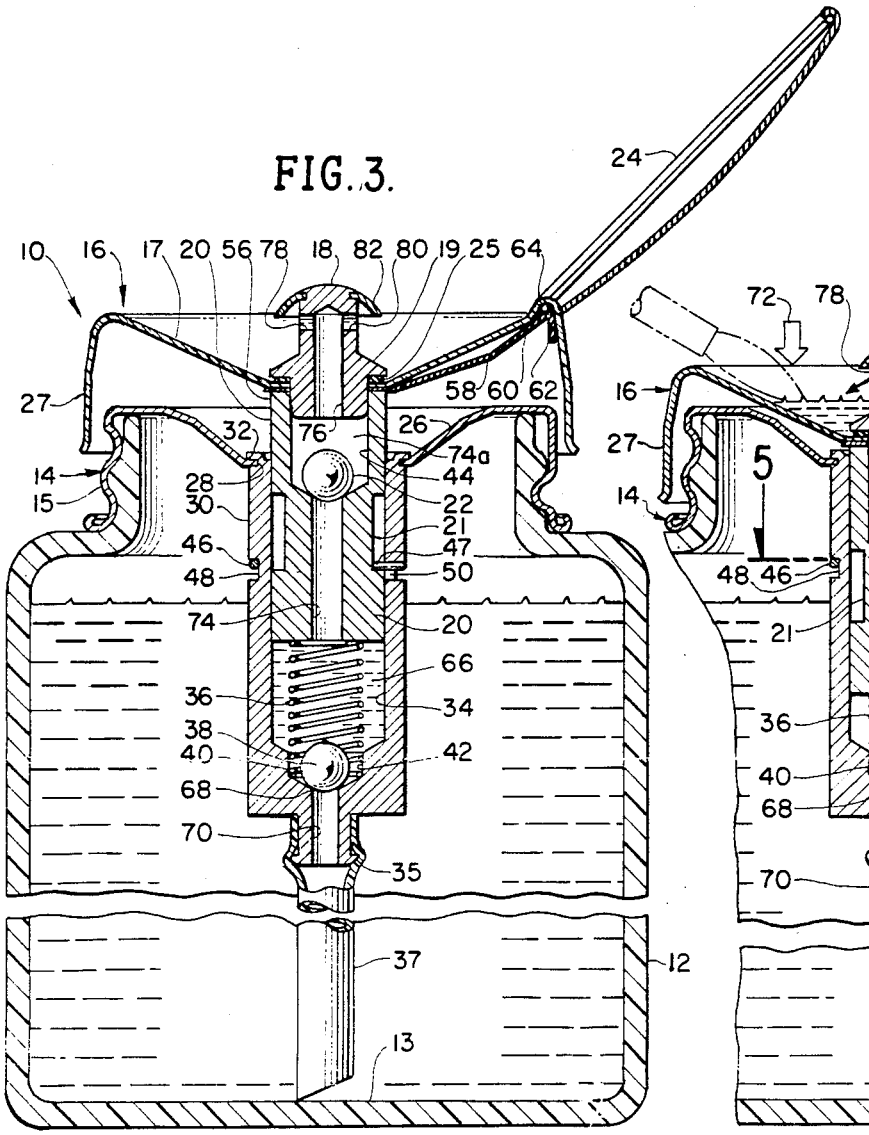
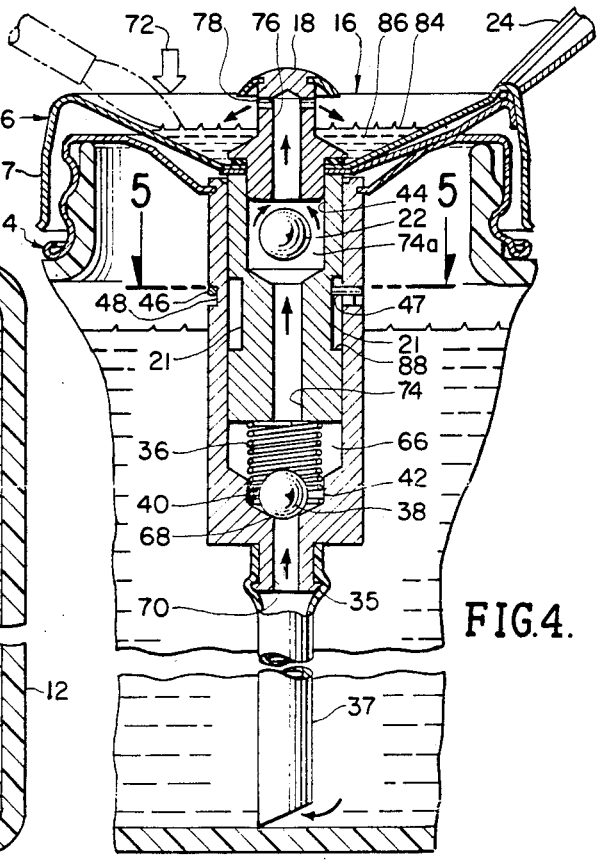
FIG. 4.

LIQUID DISPENSER

BACKGROUND OF THE INVENTION

1. Field of the Invention

The present invention relates to an improved dispenser for mixing and using an acrylic resin or the like for coating fingernails or teeth or other such applications. During mixing the subject resins and hardeners tend to thicken or harden and clog and "gum up" the inlet and other parts of the dispenser. The contaminated resin should not be mixed with the fresh supply of resin or returned to the original storage container after use.

2. Brief Description of Prior Art

In the prior art resins, such as acrylics and hardening agents or powders or other such materials, are applied as on the dentist's or manicurist's brush. If thereby contaminated and allowed to re-enter the pumping mechanism a build-up in the inlet pump mechanism requires time-consuming disassembling of the pump mechanism, cleaning the parts, or possibly discarding the unit as having been rendered inoperative.

OBJECTS AND SUMMARY OF THE INVENTION

The present invention has a major object provision of an improved container having a new and improved dispensing cap which permits a measured quantity of liquid to be pumped into an integral dish-like top; prevents its return to the container; seals the inlet and pump mechanism from the thick hardening resin in the dish; and allows fresh liquid to be dispensed by a light, downward pressure of a brush, swab or other applicator on the dish.

The invention has as a further object, provision of an improved means for dispensing from a subject storage container of difficult liquids which must be used continuously.

The invention also provides an improved bottle cap which does not require cap removal to afford access to the liquid or semi-liquid contents of the bottle nor permit undesired return flow.

The invention improves over the liquid dispensers of the type and mode of operation of Menkin, et al., U.S. Pat. No. 2,593,591.

Herein is disclosed a new and novel means for effectively sealing off a collector dish from its separate liquid reservoir by means of an elevated fluid outlet above the normal level of liquid in the dispensing dish. The parts are constructed and arranged so as to minimize liquid loss. Spillage, evaporation and squirting of liquid from the dispenser dish are avoided. The plunger mechanism is effectively actuatable simply by means of an applicator brush or the like. Thereby, a suitable liquid for fingernail care combined with an a hardening powder or the like may be conveniently and efficiently used in a manner which does not clog or gum up the dispenser or the inlets 78 and 80 therein.

These and other advantages of the invention will become apparent from the following description, claims and illustrations in the accompanying drawings.

BRIEF DESCRIPTION OF THE DRAWINGS

FIG. 1 is a perspective view of a liquid dispenser cap attached to a bottle embodying the invention with its lid in open position.

FIG. 2 is a pictorial view of the liquid dispensing cap with its lid in closed position.

FIG. 3 is a cross-sectional view thereof with the dispensing cap in up position.

FIG. 4 is a partial cross-sectional view of the dispensing cap in down position.

FIG. 5 is a partial top sectional view taken on line 5—5 of FIG. 4.

DETAILED DESCRIPTION OF THE PREFERRED EMBODIMENT

Referring now more particularly to the drawings of a illustrative preferred form of the invention, and to the reference numerals and letters marked thereon:

The liquid dispensing cap 10 as shown in FIGS. 1 and 2 of the present invention, is screwed onto a typical container or bottle 12 of stainless steel of the like. FIG. 1 shows the cap 10 in an open position, thus permiting access to the liquid dispensed into its upper cup 17. FIG. 2 shows the cap 10 with its snap lid 24 closed.

Referring now to FIG. 3, the liquid dispensing cap 10 comprises a screw-on inner cap 14 and an outer dish assembly 16 with the attached snap lid 24. The outer dish cap assembly 16 comprises an umbrella-like plug 18, a central plunger 20 containing a free-floating steel ball 22 and a snap lid 24. A peripheral collar 27 on the dish cap 16 nests over the top of the inner cap 14 to prevent contaminated liquid from entering the recessed top 26 of the inner cap 14 or seeping into the pumping mechansim. A gasket 25 seated under the flange 19 of the umbrella-like plug 18 makes this assembly leakproof.

The screw-on inner cap 14 has a recessed top surface 26, rolled threads 15 around its peripheral edge, and a cylindrical housing 30 permanently attached by being peened at its upper end 32 within a centrally located hole 28 to said cap 14. Seated within the concentric bore 34 in the housing 30 is a compression spring 36 and a free-floating steel ball 38. The lower end 40 of the spring 36 fits snugly in a reduced bore 42 which is concentric with the larger bore 34. Thus, the spring 36 can be compressed freely within the larger bore 34 and maintain its upright position. Attached to a barbed end 35 of the housing 30 is a flexible siphon tube 37 of the sufficient length to reach the bottom 13 of the bottle 12.

Slidably engaged within the concentric bore 34 of the housing 30 is a plunger 20 which is permanently affixed to the outer cap 16 by means of the umbrella plug 18 pressed tightly into the bore 44 of the plunger 20. The plunger 20 is restricted in its travel within the bore 34 by means of a retainer spring 46 seated in a recess groove 48 cut into the outer diameter of the housing 30 (see FIG. 5). A suitable hole 50 coinciding with the bottom of the groove 48 allows the inwardly bent end 47 of the retainer spring 46 to project into a recessed diameter 21 of the plunger 20, thus limiting its upward travel as forced by the compression spring 36, and also preventing the disengagement of the outer dish cap 16 from the inner screw-on cap 14 (see FIG. 3).

Clenched between the flange 19 and the upper end 56 of the plunger 20 is a leaf spring 58. The extended end 60 of the spring 58 has a curved tip 62 which exerts pressure against a wire ring 64 crimped in the peripheral edge of the snap lid 24 in such a manner as to maintain the lid 24 in an open position as shown in FIGS. 1 and 3, or snap it shut as shown in FIG. 2, to seal off undesired fumes emitting from the liquid cavity 17.

Referring to FIGS. 3 and 4, the liquid dispensing action of the pumping mechanism described above is now explained. When the cap 10 is mounted as on the threaded mouth of the bottle 12, the liquid contained in the bottle fills a chamber 66 in the pump mechanis. The steel ball 38 drops in place to seal the orifice 68 of the passage 70 centrally located in the housing 30. A light downward pressure, as indicated by arrow 72 in FIG. 4, of a brush, swab or applicator applied to the dish cap 16, forces the plunger 20 downward against the resistance of the compression spring 36 thereby forcing the liquid in chamber 66 upwardly through a vent 74 centrally located in the plunger 20, unseating the steel ball 22, and permitting the liquid to flow through a ball containment chamber **74*a* and finally through the axial passage 76 of the umbrella plug 18**.

Two diametrically opposite orifices or outlets 78 and 80 are located directly under the umbrella-like shield 82 which forms the top of the plug 18 to shield and also to direct the stream of liquid downwardly into the dish-shaped cap 16 as desired.

The outlets 78 and 80 are positioned above the surface 84 of the liquid 86 contained in the cap 16 to prevent backflow into the pump mechanism. The shield is adapted, constructed and arranged to prevent brush-contact or other contamination or touching of the outlets 78 and 80 with partially dried or thickened solutions.

When the initial pressure on the dish 16 is relieved, the compression spring 46 forces the plunger 20 upwardly until the bottom shoulder 88 of the recessed diameter 21 contacts the end 47 of the retainer spring 46. This action creates a vacuum in the chamber 66, draws up additional liquid through the siphon tube 37, dislodges the steel ball 38, and subsequently fills the chamber 66. The pumping mechanism is thus returned to its initial position as shown in FIG. 3 and is ready to drip or eject measured quantities of liquid upon the depression of the upper cap 16.

The foregoing disclosure is representative of a preferred form of the invention and is to be interpreted in an illustrative, rather than a limiting sense. The invention is to be accorded the full scope of the following claims.

I claim:

1. Apparatus for dispensing a measured quantity of liquid comprising:

(a) reservoir means for storing a quantity of the liquid;

(b) reciprocating pump means attached to the reservoir, the pump means having a liquid inlet passage means disposed in the liquid in the reservoir and a liquid outlet vent;

(c) dish means having a generally concave bottom;

(d) plug means plugging the liquid outlet vent and passing through the dish means for fixedly attaching the dish means to the reciprocating pump means such that the dish means and plug means reciprocate with the pump means, the plug means defining an axial passage in fluid communication with the liquid outlet vent of the reciprocating pump and substantially horizontally disposed outlet means in fluid communication with the axial passage, the substantially horizontally disposed outlet means being located a predetermined distance from the generally concave bottom of the dish means so as to be above the level of the measured quantity of fluid dispensed into the dish means to prevent return of the dispensed liquid to the reservoir means thereby obviating contamination of the liquid in the reservoir means; and, (e) shield means associated with the plug means to obviate contaminating contact with the substantially horizontally disposed outlet means.

2. The apparatus of claim 1 wherein the shield means comprises an umbrella-like shield means attached to the plug means extending over and radially outwardly of said substantially horizontally disposed outlet means which outlet means is positioned immediately subjacent said umbrella-like means.

3. The apparatus of claim 2 wherein the reservoir means is disposed below and in substantial axial alignement with the umbrella-like shield means, and wherein the reciprocating pump means extends axially from the reservoir means to the plug means for delivery of liquid under the umbrella-like shield means and under the protection of the umbrella-like shield means, and wherein the substantially horizontally disposed outlet means open immediately under the umbrella-like shield means for introducing a selected portion of the liquid from the reservoir means into the dish means for use.

4. The apparatus of claim 1 wherein the reservoir means has a generally vertical axis.

5. The apparatus of claim 1 wherein the shield means comprises an umbrella-like shield located on the plug means generally coaxially with the reservoir means and the dish means, and immediately above the horizontally disposed outlet means for shielding the outlet means to prevent leak back of the liquid through the outlet means.

6. The apparatus of claim 1 wherein the dish means defines an opening through the bottom and wherein the plug means defines a portion passing through the opening and engaging the reciprocating pump means.

7. A method of dispensing an acrylic-like resinous liquid, comprising the steps of:

(a) retaining the liquid in a reservoir;

(b) providing a reciprocating pump means in a fluid communication with the liquid in the reservoir;

(c) dispensing a measured quantity of liquid into an open dish positioned above the reservoir through plug means plugging a liquid outlet vent of the reciprocating pump and attaching the dish to the reciprocating pump by generally vertical axial reciprocation of the dish and plug means with respect to the reservoir, at a point defined by the plug means and vertically spaced above the dish and above the surface of any liquid in the dish for preventing the return of dispensed liquid into the reservoir, while shielding the incoming liquid against contamination at the point of said dispensing into the dish;

(d) mixing portions of hardener with said dispensed liquid;

(e) applying and using said mixed portions of liquid and hardener on a surface; and (f) disposing of any remaining portions in the dish after use.

* * * * *